US009779717B2

(12) United States Patent
Chan et al.

(10) Patent No.: US 9,779,717 B2
(45) Date of Patent: *Oct. 3, 2017

(54) SILENT MOBILE DEVICE VIBRATION

(71) Applicant: Elwha LLC, Bellevue, WA (US)

(72) Inventors: Alistair K. Chan, Bainbridge Island, WA (US); Roderick A. Hyde, Redmond, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/191,888

(22) Filed: Jun. 24, 2016

(65) Prior Publication Data

US 2016/0307556 A1 Oct. 20, 2016

Related U.S. Application Data

(63) Continuation of application No. 14/260,957, filed on Apr. 24, 2014, now Pat. No. 9,406,290.

(51) Int. Cl.
*G10K 11/178* (2006.01)
*G10K 11/175* (2006.01)

(52) U.S. Cl.
CPC ..... *G10K 11/178* (2013.01); *G10K 11/175* (2013.01); *G10K 2210/129* (2013.01); *G10K 2210/3046* (2013.01)

(58) Field of Classification Search
CPC ..... G10K 7/15; G10K 11/175; G10K 11/178; H04M 1/72577
USPC ..... 381/71.2, 71.8, 424; 455/404.2, 412.2; 705/13
See application file for complete search history.

(56) References Cited

U.S. PATENT DOCUMENTS

| | | | | |
|---|---|---|---|---|
| 5,581,619 | A | 12/1996 | Shibata et al. | |
| 7,173,604 | B2 | 2/2007 | Marvit et al. | |
| 9,332,115 | B2 * | 5/2016 | Imaeda | H04M 1/72577 |
| 9,406,290 | B2 * | 8/2016 | Chan | G10K 11/175 |
| 2003/0048920 | A1 * | 3/2003 | Van Halteren | H04R 9/063 381/424 |
| 2004/0258251 | A1 | 12/2004 | Inoue et al. | |
| 2005/0212911 | A1 | 9/2005 | Marvit et al. | |
| 2008/0162072 | A1 | 7/2008 | Copley et al. | |
| 2008/0242261 | A1 * | 10/2008 | Shimanuki | G08B 17/00 455/404.2 |
| 2011/0053564 | A1 * | 3/2011 | Imaeda | H04M 1/663 455/412.2 |
| 2015/0030189 | A1 | 1/2015 | Nabata et al. | |
| 2015/0134428 | A1 * | 5/2015 | Li | G06Q 20/327 705/13 |
| 2015/0310845 | A1 * | 10/2015 | Chan | G10K 11/175 381/71.8 |
| 2016/0307556 | A1 * | 10/2016 | Chan | G10K 11/175 |

FOREIGN PATENT DOCUMENTS

| | | |
|---|---|---|
| JP | 2013-218248 | 10/2013 |
| WO | WO 2013/153827 | 10/2013 |

* cited by examiner

*Primary Examiner* — Gerald Gauthier
(74) *Attorney, Agent, or Firm* — Foley & Lardner LLP

(57) ABSTRACT

A mobile device vibrational sound system includes a processing circuit configured to activate a selectively vibratable element based on a triggering event, and control operation of a speaker to provide a mitigation sound configured to at least partially cancel a vibrational sound resulting from activation of the vibratable element.

35 Claims, 5 Drawing Sheets

SILENT MOBILE DEVICE VIBRATION

CROSS-REFERENCE TO RELATED APPLICATIONS

This application is a continuation of U.S. patent application Ser. No. 14/260,957, filed Apr. 24, 2014, entitled "SILENT MOBILE DEVICE VIBRATION," which is incorporated herein by reference in its entirety.

BACKGROUND

A mobile phone typically has three alert settings: ringer, silent, or vibration. In the ringer setting, an audible noise is produced by the phone upon the occurrence of various events (e.g., a new text message). In the silent setting, no noise is produced by the phone upon the occurrence of various events. Finally, in the vibration setting, the phone moves rapidly (i.e., vibrates) to notify the user of an event, such as an incoming call or upcoming appointment. Typically, a user may control which setting to utilize. For example, if the user is in a movie theater, the user may select the silent setting to avoid distracting others during the movie. In some configurations, the user may choose to utilize more than one setting. For example, if the user is at a loud sporting event, the user may select the ringer and vibration settings in order to ensure that they are alerted of any incoming phone call (or other event). Thus, the various settings allow users the option of controlling how they would like to be alerted of various events received on or associated with their mobile device.

SUMMARY

One embodiment relates to a mobile device vibrational sound system that includes a processing circuit. The processing circuit is configured to activate a selectively vibratable element based on a triggering event, and control operation of a speaker to provide a mitigation sound that at least partially cancels a vibrational sound resulting from activation of the vibratable element.

Another embodiment relates to a mobile device that includes a selectively vibratable element and a processing circuit. The vibratable element is configured to vibrate in response to a triggering event, wherein a vibrational sound is created by the vibratable element. The processing circuit is configured to receive the vibrational sound, and control operation of a speaker to provide a mitigation sound that at least partially cancels the vibrational sound.

Still another embodiment relates to a mobile device vibrational sound system that includes a processing circuit. The processing circuit is configured to receive a first input, the first input including a vibrational sound; determine a mitigation sound based on the first input, such that the mitigation sound at least partially cancels the vibrational sound; and control operation of a speaker to provide the mitigation sound.

Another embodiment relates to a mobile device vibrational sound system that includes a processing circuit. The processing circuit is configured to activate a selectively vibratable element based on a triggering event, the activation of the vibratable element resulting in a vibrational sound; determine a location of the mobile device; and control operation of a speaker to provide a mitigation sound based on the location of the mobile device; wherein the mitigation sound at least partially cancels the vibrational sound.

Yet another embodiment relates to a method of at least partially cancelling a vibrational sound created by a selectively vibratable element in a mobile device. The method includes receiving a signal regarding a triggering event at a processing circuit; and controlling, by the processing circuit, a speaker based on the signal to provide a mitigation sound configured to at least partially cancel a vibrational sound created by a vibratable element in a mobile device.

Still another embodiment relates to a method of at least partially cancelling a vibrational sound. The method includes receiving a vibrational sound based on vibration of a mobile device; determining a mitigation sound based on the vibrational sound, the mitigation sound configured to at least partially cancel the vibrational sound; and providing the mitigation sound.

Another embodiment relates to a method of reducing sound created by a vibrating mobile device. The method includes receiving a signal regarding a triggering event at a processing circuit; activating, by the processing circuit, a selectively vibratable element in the mobile device based on the triggering event, the activation resulting in a generation of a vibrational sound; determining a location of the mobile device; and providing the mitigation sound based on the location, wherein the mitigation sound is configured to at least partially cancel the vibrational sound.

Yet another embodiment relates to a method of at least partially cancelling a vibrational sound created by a vibratable element in a mobile device. The method includes receiving a mitigation sound setting at a processing circuit; receiving a signal regarding a triggering event at the processing circuit; and controlling, by the processing circuit, a speaker to provide a mitigation sound based on the mitigation sound setting; wherein the mitigation sound is configured to at least partially cancel a vibrational sound created by a selectively vibratable element in a mobile device based on receipt of the signal.

Still another embodiment relates to a tangible, non-transitory computer-readable storage medium having machine instructions stored therein, the instructions being executable by a processor to cause the processor to perform various operations. The operations include receiving a signal regarding a triggering event at a processing circuit; and controlling, by the processing circuit, a speaker to provide a mitigation sound configured to at least partially cancel a vibrational sound created by a selectively vibratable element in a mobile device based on receipt of the signal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
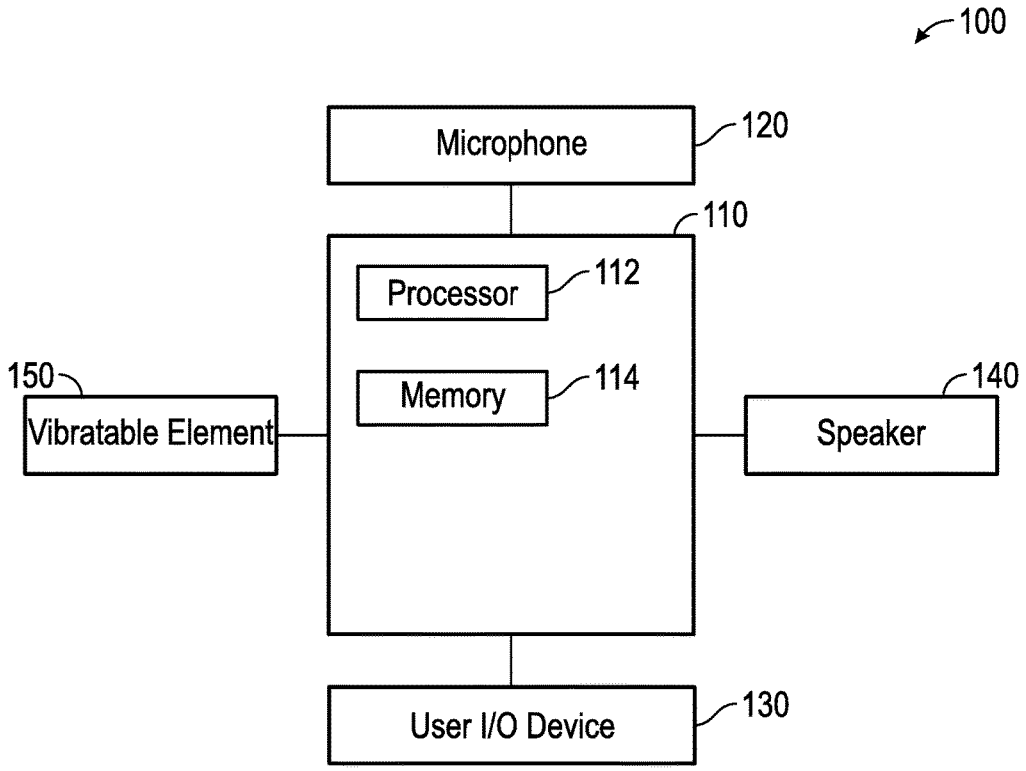
FIG. 1 is an illustration of a mobile device vibrational sound system according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, systems and methods for cancelling the noise associated with a selectively vibratable element of a mobile device are shown according to various embodiments. When a mobile device is put into a vibrational alert mode, the mobile device typically vibrates upon the occurrence of various triggering events (e.g., an incoming call, a new text message, etc.). Although the vibrational setting is intended to be silent (no noise), typically, an audible sound is produced from the actuation of a selectively vibratable element in the device (referred to herein as "vibrational sound" or "vibrational output sound"). This sound may be loud enough to dissuade users from selecting the vibrational setting on their mobile device. Moreover, users may view this sound as annoying, irritating, or unpleasant. According to various embodiments disclosed herein, a processing circuit controls operation of a speaker in a mobile device to provide a mitigation sound that cancels or substantially cancels the audible level of the vibrational sound. Accordingly, the user will feel the vibrational pulses, but hear a reduced vibrational output sound.

Referring now to FIG. 1, a mobile device vibrational sound system 100 is shown according to one embodiment. Typically, system 100 is utilized with a mobile device (e.g., mobile device 300 of FIGS. 3A-3B). Mobile device 300 may include a smartphone, a personal digital assistant ("PDA"), a tablet computer, a cellular phone, a watch, etc. As shown, system 100 generally includes processing circuit 110, microphone 120, user input/output device 130, speaker 140, and selectively vibratable element 150. System 100 may utilize the corresponding components (shown in FIG. 1) that are already present with mobile device 300 (e.g., the microphone that a user speaks into when conversing on the mobile device may be utilized as microphone 120, the one or more processors already present with mobile device 300 may be utilized as processor 112, etc.). According to another embodiment, system 100 may include separate components from the already-existing components in the mobile device.

In operation, a triggering event causes the activation of vibratable element 150 in a mobile device (e.g., mobile device 300). The triggering event may include at least one of a new text message, a new email, an incoming phone call, a reminder notification, a social media notification (e.g., acceptance of a friend request), a new photo message, etc. According to one configuration, processing circuit 110 may activate vibratable element 150 in response to reception of one or more triggering events. For example, when a new phone call is received, processor 112 of processing circuit 110 may transmit an actuation signal to vibratable element 150 to cause the mobile device to rapidly move (vibrate) to alert a user of the triggering event. In one embodiment, simultaneously or near simultaneously, processing circuit 110 controls operation of speaker 140 to provide a mitigation sound that at least partially cancels the audible level of the vibrational output sound.

As used herein, the phrase "audible level" refers to the sound level of the vibrational sound caused by vibration of the mobile device and not necessarily the sound level heard by a user of the device. As such, the mitigation sound that cancels or partially cancels the vibrational sound refers to a sound that eliminates or substantially eliminates the vibrational sound's audible level. In some embodiments, at least partial cancellation includes reducing the audible level of the vibrational sound by at least fifteen percent. In various other embodiments, the percentage is at least fifty percent. Accordingly, in FIGS. 2A-2D (described herein), the resultant sound (caused by the interaction of the vibrational sound and the mitigation sound) is characterized by a percentage decrease (in either amplitude or frequency) of the vibrational sound. For example, in FIG. 2A, the mitigation sound completely cancels the vibrational sound (i.e., the vibrational sound is reduced by one-hundred percent in audible level). In the other embodiments depicted in FIGS. 2B-2D, the vibrational sound is reduced (at times) in its audible level, but not completely cancelled.

Furthermore, as mentioned above and as used herein, the phrase "vibrational output sound" or "vibrational sound" refers to the noise caused by an actuated vibratable element 150. For example, not only does vibratable element 150 create sound from its own operation, but if the mobile device is set on a table, the sound caused by vibratable element 150 may also include the noise produced by the interaction of the device vibrating on the table. Or, in another example, if the mobile device is inside a pocket of a user along with various items (e.g., coins), the vibrational sound caused by vibratable element 150 may include the noise generated by the device vibrating against the other items.

In one embodiment, vibratable element 150 includes a vibration motor attached to an unbalanced weight. The motor rotates the unbalanced weight to cause the mobile device to vibrate. During this process, audible vibrational output sound is produced. As mobile devices vary in size and shape, so do selectively vibratable elements 150 and, in turn, the characteristics of the vibrational sound created (e.g., varying frequencies or amplitudes).

Referring back to FIG. 1, microphone 120 receives the audible vibrational output sound caused by vibratable element 150 of mobile device 300. In one embodiment, microphone 120 may include a pre-existing microphone within device 300. For example, microphone 120 may include the microphone that a user speaks into when talking on the device. In another embodiment, as mentioned above, microphone 120 may be a separate component from other microphones included with device 300. In various embodiments, microphone 120 may include dynamic, condenser, ribbon, crystal, or other types of microphones. Moreover, microphone 120 may include various directional properties, such that microphone detects and receives all or most of the vibrational sound caused by vibratable element 150. For example, microphone 120 may include omnidirectional, bidirectional, and unidirectional characteristics, where the directionality characteristics indicate the directions that microphone 120 may detect sound from (e.g., omnidirectional microphone picks up sound evenly or substantially evenly from all directions).

In operation, microphone 120 receives the vibrational output sound in an acoustical format (i.e., audible noise). Microphone 120 converts the acoustical vibrational output sound into an electrical energy format, and transmits this electrical energy signal to processing circuit 110. In turn, processing circuit 110 determines an electrical signal corresponding to an audible mitigation sound that at least partially cancels the audible vibrational output sound. Processing circuit 110 provides the determined electrical mitigation sound signal to speaker 140. Speaker 140 converts the electrical mitigation sound signal to an audible mitigation sound and emits the audible mitigation sound to at least partially cancel the audible vibrational output sound.

Processing circuit 110 controls operation of speaker 140. According to one embodiment, speaker 140 includes a pre-existing speaker in device 300, such as the transmission speaker that allows a user to hear another person speaking during a phone conversation. According to another configuration, speaker 140 is separate and distinct from other speakers in device 300. Speaker 140 may include directional speakers that only transmit mitigation sounds in one or a few limited directions specific to the transmission direction of the vibrational output sound. Accordingly, the mitigation sound provided by speaker 140 may be prevented from becoming audible to the user (although the vibrational sound has been cancelled). In some embodiments, device 300 includes multiple speakers, and the processing circuit 110 controls the directionality of the mitigation sound by selecting which speaker or speakers to use in emitting the mitigation sound.

As shown in FIG. 1, processing circuit 110 includes processor 112 and memory device 114. In some embodiments, the functions of processing circuit 110 (and processor 112) described herein are performed by instructions (e.g., software) on machine-readable media including various hardware components. Processor 112 may be implemented as a general-purpose processor, an application specific integrated circuit (ASIC), one or more field programmable gate arrays (FPGAs), a digital-signal-processor (DSP), a group of processing components, or other suitable electronic processing components. In comparison, memory device 114 may be configured as one or more memory devices, which are configured to store various mitigation sound data, vibrational output sound data, and location data (i.e., the locations that correspond with particular vibrational and mitigation sound data). Memory 114 may be or include non-transient volatile memory or non-volatile memory. Memory 114 may include database components, object code components, script components, or any other type of information structure for supporting the various activities and information structures described herein. Memory 114 may be communicably connected to processor 112 (and the other components of system 100) and provide computer code or instructions for executing the processes described herein.

Processing circuit 110 may receive one or more inputs from microphone 120 and/or input/output device 130. As mentioned above, microphone 120 may detect the vibrational sound caused by vibratable element 150 and transmit that sound as an electrical signal to processing circuit 110. In addition to this input, via input/output device 130, processing circuit 110 may receive at least one of an activation input, a mitigation sound setting input, and a mode selection input. According to one embodiment, the activation input may include activation/deactivation of processing circuit 110. For example, in a mobile device application embodiment of circuit 110, processing circuit 110 may be selectively activated and deactivated via on/off button 310 (see FIG. 3A). Processing circuit 110 may also receive a mitigation sound setting input. The mitigation sound setting input may include a frequency, a phase, and/or an amplitude input that affects the characteristics of the audible mitigation sound emitted by speaker 140. For instance, a frequency input may indicate that the mitigation sound should preferentially cancel low frequency components of the vibrational sound, or alternatively that it should preferentially cancel high frequency components. A phase input may indicate a phase shift which the mitigation sound should apply to the vibrational sound; in one embodiment a 180 degrees phase shift can be used to maximize cancellation (i.e., a phase inverted mitigation sound relative to the vibrational output sound). An amplitude input may indicate an absolute amplitude level for the mitigation sound, or may indicate a mitigation amplitude relative to that of the vibrational sound. Accordingly, the modified audible mitigation sound may completely cancel or only partially cancel the audible vibrational output sound (see FIGS. 2A-2D). Finally, processing circuit 110 may operate in three distinct modes, where the mode selection is received via input/output device 130. Thus, in one embodiment, input/output device 130 includes mobile device 300 and any buttons (physical or digital) on device 300 (e.g., on/off button 310).

Referring now to FIGS. 2A-2D, the canceling and partial canceling effects of the mitigation sound are shown according to various embodiments. In regard to FIGS. 2A-2D, the sound waves depicted refer to the audible sound waves (e.g., the audible mitigation sound as opposed to the electrical signal mitigation sound received by circuit 110). Accordingly, as seen in FIGS. 2A-2D, the mitigation sound interacts with the sound created by vibratable element 150 to create a resultant sound wave. Sound propagates through a medium (e.g., air) as a waveform, which enables other waveforms to either constructively or destructively interfere. Destructive interference refers to reduction of the propagating sound wave (e.g., the audible noise may be reduced). In comparison, constructive interference refers to an increase of the propagating sound wave (e.g., the propagating wave and other wave are added together upon their interaction). According to various embodiments disclosed herein, the mitigation sound destructively interferes with the sound wave (vibrational output sound wave) caused by vibratable element 150 to cancel or partially cancel its audible level.

Figure 2A:
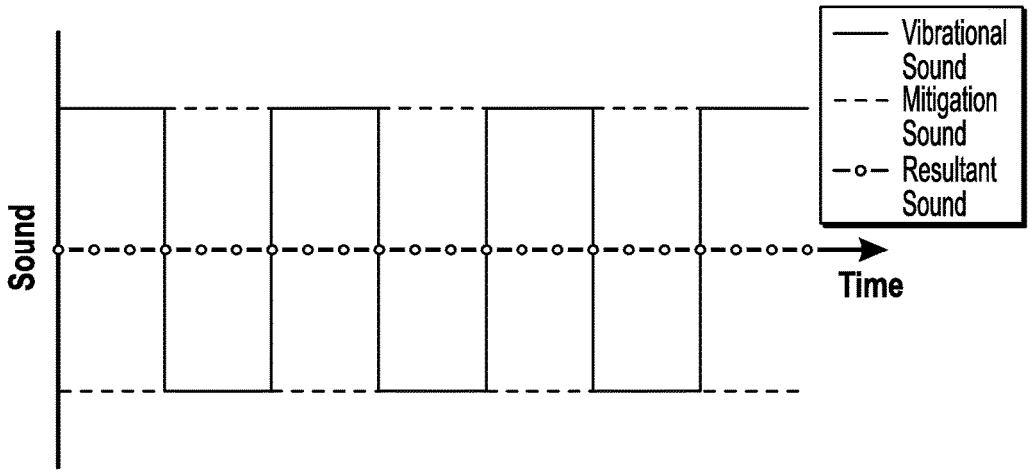
FIGS. 2A-2D are diagrams of mitigation sound waves interfering with sound waves generated by a vibrating mobile device according to one embodiment.
Figure 2B:
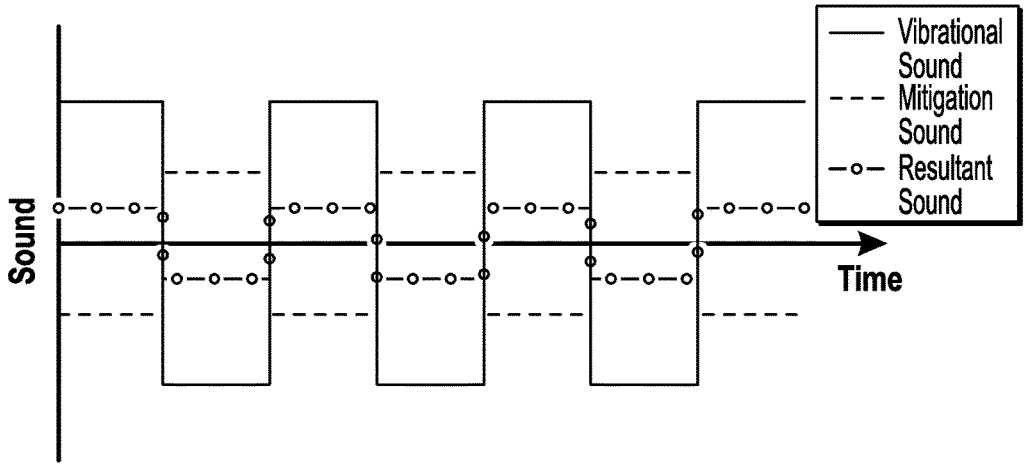

Referring more particularly to FIG. 2A, processing circuit 110, via speaker 140, provides a mitigation sound of the same frequency and amplitude as that of the shown vibrational output sound wave. The two waveforms are of the same amplitude and completely out of phase, such that they interact to produce zero audible sound (see resultant sound wave). In this embodiment, the user of the mobile device feels the vibration from the vibratable element but does not hear the sound created by the vibratable element. According to various alternate embodiments, the mitigation sound may only be partially out-of-phase with the vibrational sound, such that a reduced audible noise of the vibrational sound is created that may be heard by a user of the device.

Figure 2C:
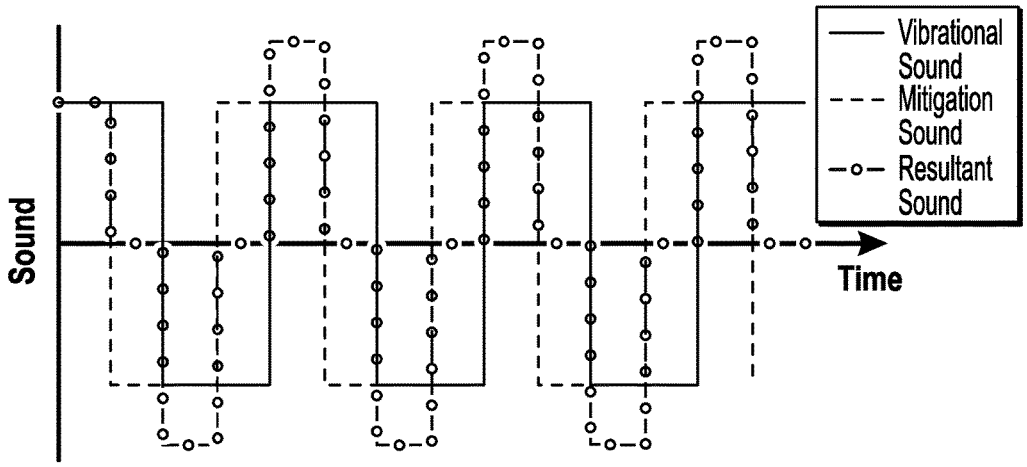
Figure 2D:
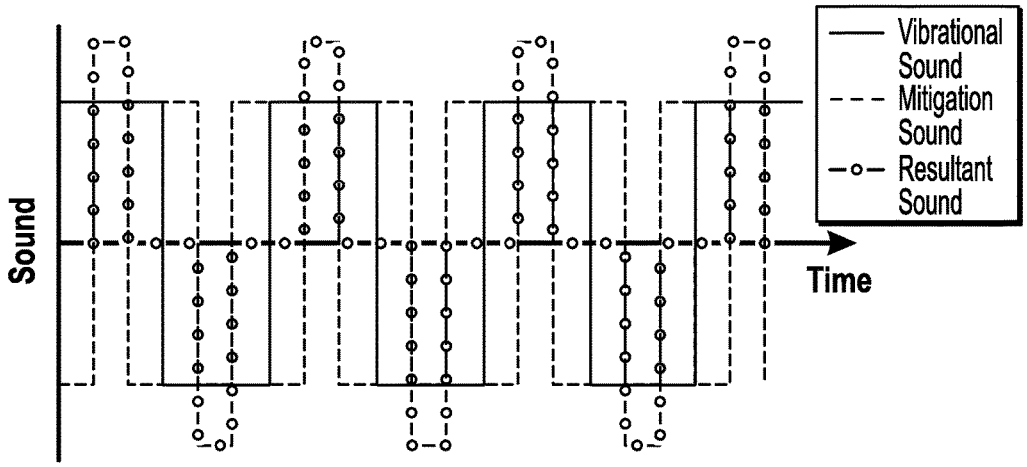

As mentioned above, in some embodiments, processing circuit 110 may receive frequency, phase, and/or amplitude inputs that adjust the mitigation sound characteristics via input/output device 130. Accordingly, the resultant sound (represented in FIGS. 2A-2D as the dash-dot-dash line) produced by the interaction of the mitigation sound and the vibrational sound may be adjusted. For example, in FIG. 2B, the mitigation sound is at a relatively lesser amplitude but the same frequency as the vibrational output sound wave. Accordingly, the resultant sound does not completely cancel the vibrational output sound wave. As such, the vibrational output sound may be heard by a user of the device (dependent on the location of the user in relation to the device). In comparison, FIG. 2C depicts a mitigation sound of the same amplitude but of a different phase as the vibrational output sound wave. As such, the vibrational output sound may be either cancelled to a shorter duration, or increased in audible level due to constructive interference. Similarly, in FIG. 2D, the frequency of the mitigation sound wave has been increased relative to the frequency of the vibrational sound wave. As such, the vibrational output sound may be either cancelled to a shorter duration, or increased in audible level due to constructive interference. Thus, according to various embodiments, processing circuit 110 may enable adjustment of the duration and volume of the vibrational output sound from its interaction with the mitigation sound via frequency, phase, and amplitude inputs.

Figure 3B:
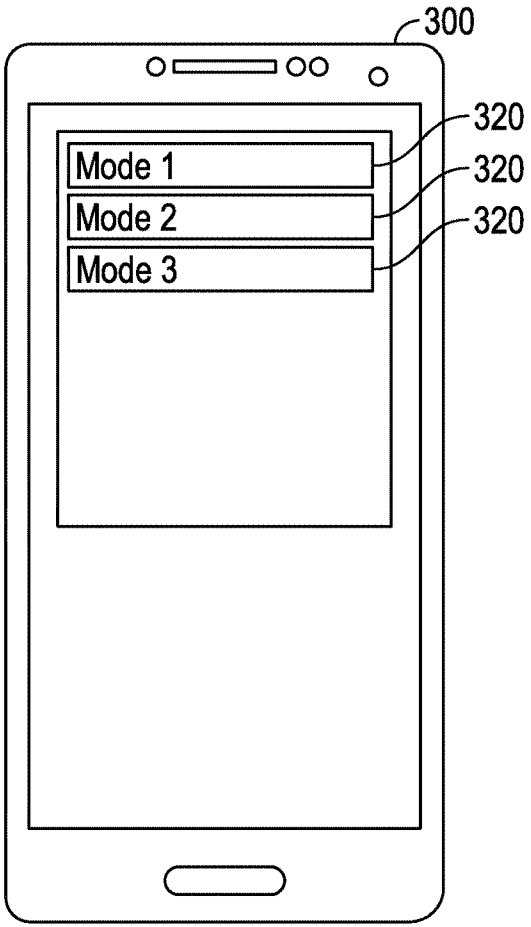
FIGS. 3A-3B are illustrations of a user interface for a mobile device vibrational sound system according to one embodiment.
Figure 3A:
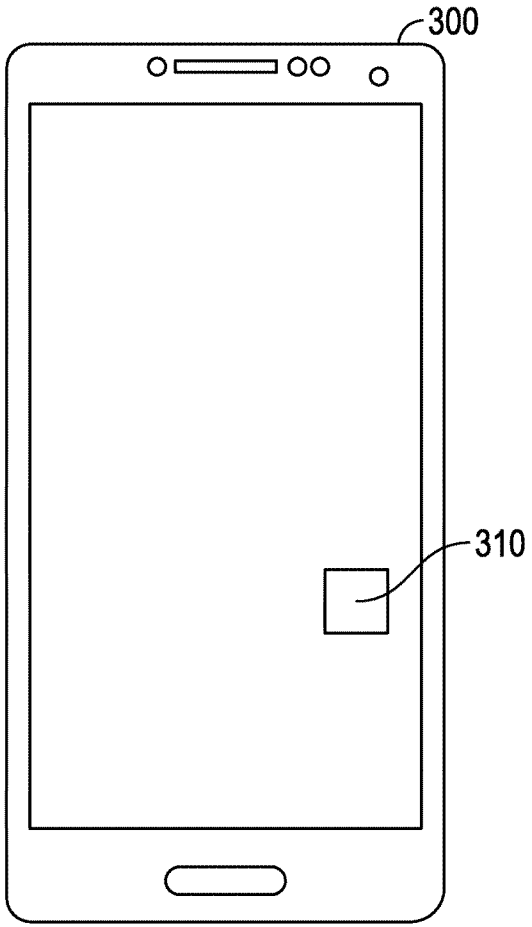

Referring to FIGS. 3A-3B, not only may processing circuit 110 be selectively activated via on/off button 310 on device 300 (activation input), but in some embodiments, after activation of processing circuit 110, a user may select an application mode of processing circuit 110. In one embodiment, the modes are selected via mode selector 320 buttons. In various other embodiments, processing circuit 110 is operated in one fixed mode only, and a user may not adjust the mode.

In a first mode, processing circuit 110, via speaker 140, provides a predetermined audible sound emission that may (e.g., exactly or partially, based on, e.g., a frequency, phase, and amplitude input) destructively interfere with a vibrational sound output to cancel the vibrational sound caused by vibratable element 150 of the mobile device. In the first mode, regardless of where mobile device 300 is located or the amplitude, phase, and frequency of the vibrational sound, processing circuit 110 provides a predetermined emission mitigation sound. In one embodiment, the predetermined sound emission (e.g., its amplitude, phase, frequency, or duration) can be based on the commanded vibratory excitation of vibratable element 150, but not upon measurements by the mobile device of the vibrational sound actually produced. In other embodiments one or more characteristics of the predetermined sound emission (e.g., its amplitude, phase, frequency, or duration value) may be fixed (e.g., processing circuit 110 commands speaker 140 to provide a mitigation sound for a fixed duration of one second). In some other embodiments, processing circuit 110 may command speaker 140 to provide the mitigation sound at a fixed duration based on an activation duration of the selectively vibratable element 150 (e.g., if the vibratable element is activated for four one-second increments based on a specific triggering event (e.g., a received phone call), then processing circuit 110 may command speaker 140 to provide a mitigation sound for each of the four one-second increments). In another embodiment, the predetermined amplitude level is based on an activation level (i.e., preset audible level) of the selectively vibratable element (e.g., if the activated vibratable element provides 3 decibels of vibrational sound output, then processing circuit 110 controls speaker 140 to provide 3 decibels of mitigation sound). In some embodiments, the activation level of the selectively vibratable element 150 may be adjusted via input/output device 130.

A location-based configuration corresponds to a second mode. In the second mode, processing circuit 110 may store predetermined vibrational sound emission characteristics for various locations, and provide a mitigation sound (via speaker 140) that corresponds with the stored sound emission characteristic for each location. According to one embodiment, processing circuit 110 (e.g., memory device 114) stores a plurality of sound emission characteristics (e.g., one or more look-up tables). For example, the vibrational sound output (e.g., amplitude or frequency spectrum) from a mobile device vibrating on a table (e.g., 30 decibels) may be different than the vibrational sound output from a mobile device vibrating in a user's pants pocket (10 decibels). As such, processing circuit 110 may provide different mitigation sounds based on the location of the mobile device. Location determination of the mobile device may be based on a user input, a comparison of the received vibrational sound and stored vibrational sounds, and/or based on one or more sensors included with the mobile device that determine the location of the device. As such, in one embodiment, processing circuit 110 may receive location information from a user of the device via input/output device 130 (i.e., mobile device 300). For example, the user may provide a voice command to the device indicating that the device will now be inserted into their pants pocket for the next three hours. Accordingly, processing circuit 110 provides a mitigation sound via speaker 140 corresponding to the determined mitigation sound for when the device is within the user's pocket. In some embodiments, a user may input their location and a duration of how long the user will be in that location via input/output device 130. As such, processing circuit 110 provides a mitigation sound for that location for the duration specified by the user; such location-based mitigation sounds may be generated in real-time, or may be stored in memory device 114 and recalled when required.

In another embodiment, processing circuit 110 may determine the location of mobile device 300 based on a comparison of the vibrational sound and stored vibrational sounds (e.g., in memory device 114). For example, microphone 120 detects the vibrational sound caused by activation of vibratable element 150 and provides the vibrational sound to processing circuit 110. Processing circuit 110 compares the received vibrational sound with the stored vibrational sounds. If the detected vibrational sound matches or substantially matches a stored vibrational sound, then processing circuit 110 determines the location of the device 300 to be the location corresponding with the matched vibrational sound. Processing circuit 110 may then provide a mitigation sound based on the determined location. If the detected vibrational sound does not match, processing circuit 110 may either not provide a mitigation sound or provide a predetermined mitigation sound (i.e., the first mode of operation). Match or substantial match may be preset via input/output device 130. For example, a user may preset matches to occur where the vibrational sound is within a certain percentage or value of a stored vibrational sound. This may be based on sound wave characteristics, such as frequency, input, and amplitude (e.g., within a certain percentage of an amplitude, or a frequency, etc.).

In another embodiment, processing circuit 110 may determine the location based on one or more sensors and/or transceivers (e.g., a location positioning system) in device 300. For example, light and accelerometer sensors included with the device may indicate darkness and slight movement that corresponds with the device being located within a pants pocket of a user. Accordingly, processing circuit 110 may determine that the device is within the pants pocket of the user and provide the corresponding mitigation sound. For example, inclination and accelerometer sensors included with the device may indicate that the device is motionless in a horizontal configuration. Processing circuit 110 may determine that the device is on a table or other flat surface and provide the corresponding mitigation sound. Thus, in the second mode, memory device 114 may record a plurality of different sound profiles for various location positions of the mobile device. The processing circuit 110 may generate a mitigation sound (via speaker 140) corresponding to each location and store the corresponding mitigation sound in memory device 114. In response to a triggering event (e.g., a received phone call), processing circuit 110 may provide a mitigation sound for the determined location of mobile device 300.

Finally, in a closed loop third mode, processing circuit 110 receives the vibrational sound as an input and, in response, determines and provides to speaker 140 a mitigation sound (as an electrical signal) that will at least partially cancel the audible vibrational sound detected. In operation, microphone 120 receives the audible vibrational sound, converts the audible vibrational sound to an electrical signal, and provides the electrical signal to processing circuit 110. In some embodiments, the electrical signal includes characteristics of the vibrational sound (e.g., the vibrational sound wave characteristics, such as an amplitude, a frequency, and a phase of the vibrational sound), such that processing circuit 110 may determine characteristics (e.g., amplitude, frequency, etc.) for a mitigation sound that, when emitted by speaker 140, will at least partially cancel the vibrational sound. Depending upon the microphone directionality and reception characteristics, its measured vibrational sound can be predominantly only that generated by the vibrational element, or may include the already emitted mitigation sound and hence represent the net vibrational sound emitted from the mobile device. Processing circuit 110 may continuously modify the provided vibrational sound in response to a changing detected vibrational sound. In summary of the three modes, via speaker 140, processing circuit 110 provides a predetermined mitigation sound in the first mode regardless of the characteristics of the vibrational output sound; processing circuit 110 provides a variable mitigation sound based on generated or stored sound emissions characteristics for various device locations in the second mode; and, in the third mode, processing circuit 110 provides a mitigation sound based on the detected vibrational output sound.

Figure 4C:
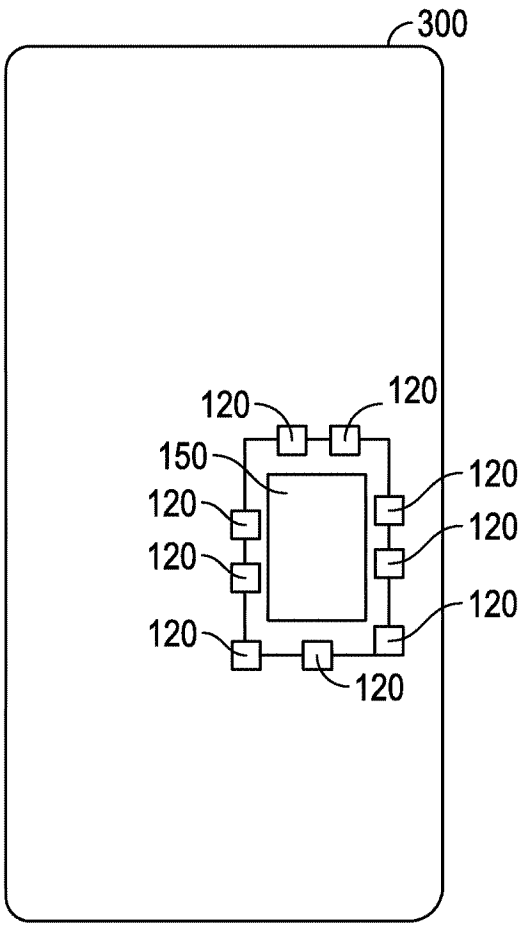
FIGS. 4A-4C are illustrations of a mobile device vibrational sound system implemented in a mobile device according to one embodiment.
Figure 4B:
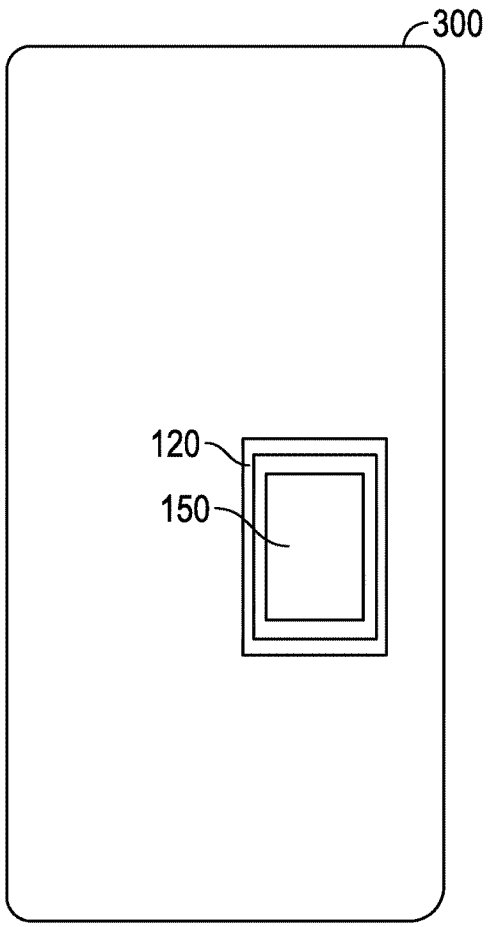
Figure 4A:
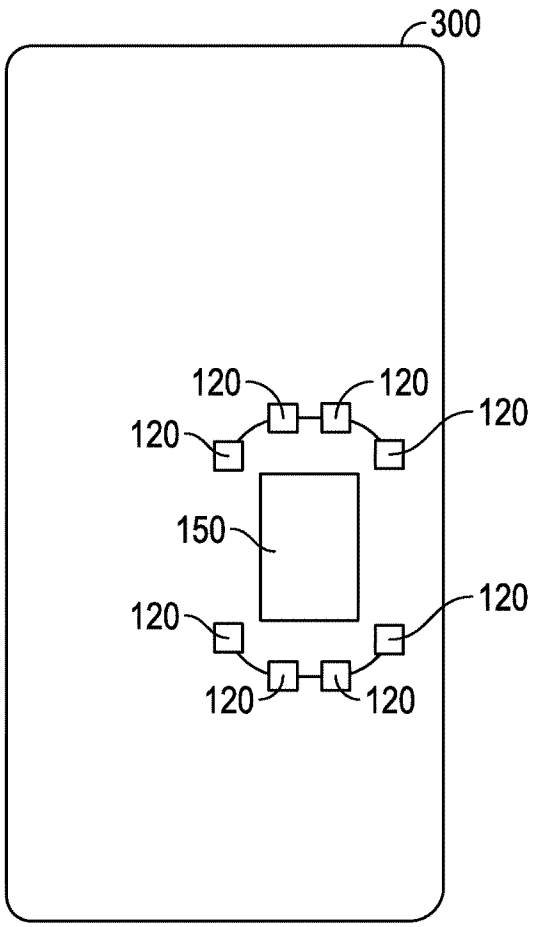

Referring now to FIGS. 4A-4C, implementations of processing circuit 110 with device 300 are shown according to various example embodiments. In FIG. 4A, a plurality of microphones 120 are implemented partially around selectively vibratable element 150 within device 300. In comparison, FIG. 4C depicts microphones 120 completely surrounding selectively vibratable element 150. According to another configuration, in FIG. 4B, microphone 120 is arranged in a continuous fashion around vibratable element 150. Depending on the size and shape of vibratable element 150 (and mobile device 300), a wide variety of configurations are possible, with only a few such iterations depicted in FIGS. 4A-4C. For example, microphone 120 may include a three-dimensional aspect. Accordingly, the microphone may completely surround vibratable element 150 in order to receive all or mostly all possible vibrational output sound, such that circuit 110 may provide, via speaker 140, the appropriate mitigation sound (i.e., in the third application mode described above).

Figure 5:
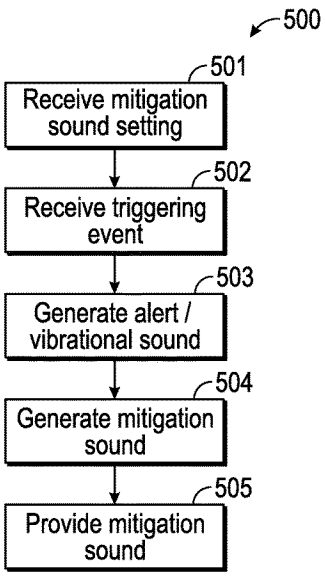
FIG. 5 is a diagram of a method of providing a mitigation sound in response to a triggering event received by a mobile device according to one embodiment.

Referring next to FIG. 5, method 500 of cancelling or at least partially cancelling the sound associated with a selectively vibratable element in a mobile device is shown according to one embodiment. According to one embodiment, method 500 may be a computer-implemented method utilizing system 100. Method 500 may be implemented using any combination of computer hardware and software. According to one embodiment, method 500 is implemented when the mobile device is placed in a vibrational alert mode (including a supplemental ringer setting). According to another embodiment, method 500 requires activation via, for example, on/off button 310 as shown in the example in FIG. 3A. In some embodiments, method 500 includes receiving a mitigation sound setting (501). Processing circuit 110 may receive a frequency, phase, and/or amplitude input that adjusts the provided mitigation sound of process 504. Accordingly, the provided mitigation sound may partially or completely cancel the audible vibrational sound, and in some alternate embodiments (see FIG. 2C-2D), constructively interfere with the vibrational sound to increase its volume.

In operation, method 500 is initiated by reception of a triggering event (502). As mentioned above, a triggering event may include at least one of a new text message, a new email, an incoming phone call, a reminder notification, a social media notification (e.g., acceptance of a friend request), a new photo message, etc. In some embodiments, processing circuit 110 receives a signal based on the triggering event. In response, processing circuit 110 causes activation of vibratable element 150 in device 300 (503). The vibratable element 150 vibrates to alert a user of the mobile device of the triggering event. In alerting the user, the actuated vibratable element 150 also generates an audible vibrational sound. To at least partially cancel the audible vibrational sound, processing circuit 110 generates a mitigation sound which is provided by speaker 140 (504). With the exception of adjusting the frequency and amplitude of the mitigation sound (i.e., process 501), method 500 corresponds with the first mode of processing circuit 110 (i.e., a predetermined sound emission characteristic).

Figure 6:
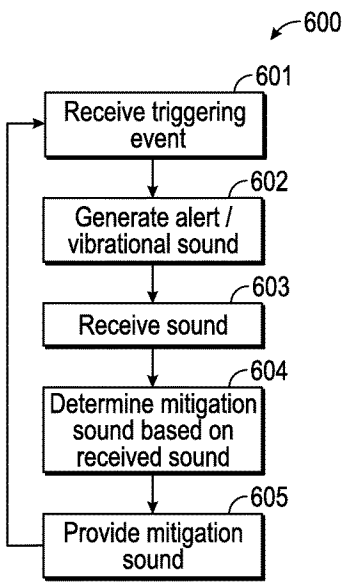
FIG. 6 is a diagram of a method of providing a mitigation sound based on reception of a vibrational sound according to one embodiment.

Referring next to FIG. 6, method 600 of providing a mitigation sound in response to the vibrational sound created by a selectively vibratable element in a mobile device is shown according to one embodiment. According to one embodiment, method 600 is implemented with system 100 of FIG. 1. Furthermore, method 600 may be implemented with any combination of computer hardware and software. Method 600 may be initiated by the reception of a triggering event (601). In response, processing circuit 110 may generate an alert (602). The alert includes the processing circuit 110 actuating a vibratable element in the mobile device to alert the user. As mentioned above, in alerting the user, the vibratable element also generates a vibrational sound. In one embodiment, microphone 130 detects the audible vibrational sound, converts it to an electrical signal, and transmits the electrical vibrational sound signal to processing circuit 110. Processing circuit receives the vibrational sound (603) and determines a mitigation sound based on the received vibrational sound (604). In one embodiment, processing circuit 110 determines a mitigation sound that cancels the vibrational sound. In various other embodiments, processing circuit 110 determines a mitigation sound that only partially cancels the vibrational sound. After determination, processing circuit 110 provides the vibrational sound via speaker 140 (605).

Method 600 corresponds with the third operation mode of processing circuit 110. As such, method 600 may be operated continuously. For example, mobile device 300 is within a pants pocket of a user. If an incoming call is received, a signal based on the incoming call is received by processing circuit 110. In response, processing circuit 110 triggers activation of the vibratable element to alert the user. The actuated vibratable element causes a vibrational sound. Processing circuit 110 responds to the noise produced initially in the user's pocket to provide a mitigation sound to cancel that noise. However, as the user moves the phone closer to their head (before answering the call, which would stop the selectively vibratable element), the vibrational output sound changes. In the user's pocket, the vibrational sound may be relatively less loud (alternatively, may be greater if the phone is vibrating against an item, e.g., loose change) as compared to the sound created in the user's hand. Because method 600 may be operated continuously, processing circuit 110 may continue to provide an ever-changing mitigation sound that corresponds with the received sound data. As such, although the vibrational sound may decrease when the phone is in the user's hand, the mitigation sound adapts to decrease and at least partially cancel the changing vibrational sound.

An example implementation of method 600 is as follows. A user may download an application for system 100 to their smartphone. Thus, the components of system 100 (e.g., speaker 140) are pre-existing in the smartphone (and, not separate components as in an alternate embodiment). The user may open up and choose to activate the application when the phone is in a vibrational alert setting. The user may also choose when to use the application. For example, the user may wish to only use the application for incoming phone calls and not incoming text messages due to the typically extended vibrational alerts for incoming phone calls versus incoming text messages. As such, when the smartphone receives a phone call, the application (via one or more processors in the phone) detects the sound created by the selectively vibratable element in the smartphone. Concurrently, the application determines a mitigation sound that will at least partially cancel the sound created by the vibratable element. The application provides this mitigation sound to a speaker of the phone, and the speaker emits the mitigation sound. The mitigation sound destructively interferes with the vibrational sound caused by the vibratable element in the phone to at least partially cancel the vibrational sound. In some embodiments, the user may (via one or more buttons on the smartphone) adjust the frequency, phase, and/or amplitude of the provided mitigation sound to only partially cancel the sound caused by the vibratable element. Ultimately, the user is able to reduce the audible level of the resultant sound, while maintaining the physical vibrations associated with a vibrational alert setting of a mobile device.

Figure 7:
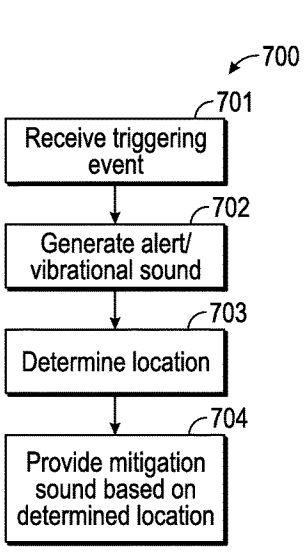
FIG. 7 is a diagram of a method of providing a mitigation sound based on the location of a mobile device according to one embodiment.

Referring to FIG. 7, method 700 of providing a mitigation sound based on a location is shown according to one embodiment. According to one embodiment, method 700 may be implemented with system 100. According to another embodiment, method 700 corresponds with the second mode of processing circuit 110, described above (i.e., a configuration where mitigation sounds are provided based on various locations, rather than in response to the received sounds from the vibratable element, like in third mode).

Operations 701-702 are analogous to the operations of 601-602 described above in regard to method 600. At 703, processing circuit 110 determines the location of the mobile device. Method 700 may begin by receiving sound data for a plurality of locations (701). According to one embodiment, a vibrating alert may be initiated at each location. Processing circuit 110 may determine the location in accord with the techniques described above (e.g., by user input, a comparison of the received vibrational sound and the stored vibrational sounds, and/or by a location-determining system, e.g., a global positioning system). After the location is determined, processing circuit 110 determines the appropriate location specific mitigation sound. In one embodiment, a plurality of location specific mitigation sounds are stored in one more memory devices of processing circuit 110. In some embodiments, each location corresponds with a different mitigation sound. For example, the vibrational sound created by an actuated vibratable element in a mobile device on a wooden table is likely different than that produced on a bed pillow.

In some embodiments, a manufacturer may include mitigation sounds for a variety of locations with processing circuit 110. Accordingly, a user may select which location they are in (or, a similar location, e.g., a library and a movie theater) on the mobile device. In other embodiments, a user may record, via microphone 120, a vibrational sound generated by a vibratable element 150 for a plurality of locations. Processing circuit 110 determines mitigation sounds for each recorded vibrational sound. As such, a user may be able to continuously update memory 114 of processing circuit 110 with different vibrational sounds for each location. In turn, the user may have a wide array of location-specific mitigation sounds that may be utilized. After processing circuit 110 determines the location of the mobile device, the processing circuit 110 provides (via speaker 140) the corresponding mitigation sound for that location (704). The mitigation sound at least partially cancels the vibrational sound. In some embodiments, a microphone of the mobile device may detect the vibrational sound and, by comparing its characteristics to one or more stored vibrational sounds corresponding to different locations (e.g., pants, table, etc.), can determine the location of the mobile device, and hence which mitigation sound to deliver.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of at least partially cancelling a vibrational sound created by a selectively vibratable element in a mobile device, comprising:

receiving a signal regarding a triggering event at a processing circuit; and controlling, by the processing circuit, a speaker to provide a mitigation sound configured to at least partially cancel a vibrational sound created by a selectively vibratable element in a mobile device based on receipt of the signal and a location of the mobile device.

2. The method of claim 1, wherein the mitigation sound comprises a phase inverted representation of the vibrational sound.

3. The method of claim 1, wherein the triggering event includes at least one of a text message, an email message, an incoming phone call, a reminder notification, a social media notification, and a photo message.

4. The method of claim 1, wherein the mobile device includes at least one of a smartphone, a cellular phone, a tablet computer, a PDA, and a watch.

5. The method of claim 1, wherein the speaker is configured to provide the mitigation sound in a direction selected by the processing circuit to interfere with and cause the at least partial cancellation of the vibrational sound.

6. The method of claim 5, wherein the processing circuit is configured to select the direction by selecting at least one speaker from a plurality of speakers.

7. The method of claim 1, wherein the processing circuit is configured to be operable in a first mode, a second mode, and a third mode.

8. The method of claim 7, wherein in the first mode, the processing circuit is configured to control operation of the speaker to provide the mitigation sound at a predetermined amplitude and duration.

9. The method of claim 8, wherein the amplitude is based on an activation level of the selectively vibratable element.

10. The method of claim 8, wherein the predetermined duration is based on an activation duration of the selectively vibratable element.

11. The method of claim 7, wherein in the second mode, the processing circuit is configured to control operation of the speaker to provide the mitigation sound based on the location of the mobile device.

12. The method of claim 11, wherein the processing circuit is configured to determine the location of the mobile device based on at least one of a user input identifying the location and a utilization of a location positioning system.

13. The method of claim 11, wherein the processing circuit includes a memory device configured to store a plurality of vibrational sounds for a plurality of locations of the mobile device.

14. The method of claim 13, wherein the processing circuit determines a location specific mitigation sound for each location within the plurality of locations based on the vibrational sound for each location.

15. The method of claim 13, wherein the processing circuit includes a memory device configured to store a plurality of location specific mitigation sounds for the plurality of locations of the mobile device.

16. The method of claim 7, wherein in the third mode, the processing circuit is configured to control operation of the speaker to provide the mitigation sound based on sound wave characteristics of the vibrational sound.

17. The method of claim 16, wherein the sound wave characteristics include at least one of an amplitude, a phase, and a frequency.

18. A method of at least partially cancelling a vibrational sound caused by the vibration of a mobile device, comprising:

receiving a vibrational sound based on vibration of a mobile device;

determining a mitigation sound based on the vibrational sound and a location of the mobile device, the mitigation sound configured to at least partially cancel the vibrational sound; and providing the mitigation sound.

19. The method of claim 18, further comprising receiving the vibrational sound by a microphone, the microphone configured to receive the vibrational sound in an acoustical format, convert the acoustical format of the vibrational sound into an electrical signal, and provide the electrical signal to a processing circuit of the mobile device.

20. The method of claim 18, further comprising providing the mitigation sound by a speaker controlled by the processing circuit, wherein the speaker is configured to provide the mitigation sound in a direction selected by the processing circuit to directly interfere with and cause the at least partial cancellation of the vibrational sound.

21. The method of claim 18, wherein the mitigation sound comprises a phase inverted representation of the vibrational sound.

22. The method of claim 18, wherein the mobile device is configured to vibrate based on reception of a triggering event.

23. The method of claim 18, further comprising providing the mitigation sound continuously based on the received vibrational sound.

24. The method of claim 18, further comprising receiving an input, and adjusting the mitigation sound based on the input.

25. The method of claim 24, wherein the adjustment includes at least one of an amplitude input, a phase input, and a frequency input.

26. The method of claim 18, wherein the partial cancellation includes reducing an audible level of the vibrational sound by at least fifteen percent.

27. The method of claim 26, wherein the audible level is a sound level of the vibrational sound at the mobile device.

28. A method of reducing sound created by a vibrating mobile device, comprising:

receiving a signal regarding a triggering event at a processing circuit;

activating, by the processing circuit, a selectively vibratable element in the mobile device based on the triggering event, the activation resulting in a generation of a vibrational sound;

determining a location of the mobile device; and providing a mitigation sound based on the location, wherein the mitigation sound is configured to at least partially cancel the vibrational sound.

29. The method of claim 28, further comprising providing the mitigation sound by a speaker controlled by the processing circuit.

30. The method of claim 29, wherein the speaker is configured to provide the mitigation sound in a direction selected by the processing circuit to interfere with and cause at least partial cancellation of the vibrational sound.

31. The method of claim 30, wherein the processing circuit is configured to select the direction by selecting at least one speaker from a plurality of speakers.

32. The method of claim 28, wherein the processing circuit includes a memory device configured to store a plurality of vibrational sounds for a plurality of locations of the mobile device.

33. The method of claim 32, wherein the processing circuit is configured to determine the location of the mobile device from the plurality of locations based on a comparison of the vibrational sound and the stored vibrational sounds.

34. The method of claim 32, wherein the processing circuit determines a location specific mitigation sound for each location within the plurality of locations based on the vibrational sound for each location.

35. The method of claim 28, wherein the processing circuit is configured to determine the location of the mobile device based on at least one of a user input identifying the location of the mobile device and a utilization of a location positioning system.

* * * * *